US008471673B2

(12) United States Patent
Tanaka et al.

(10) Patent No.: US 8,471,673 B2
(45) Date of Patent: Jun. 25, 2013

(54) VARISTOR AND METHOD FOR MANUFACTURING VARISTOR

(75) Inventors: Hitoshi Tanaka, Tokyo (JP); Katsunari Moriai, Tokyo (JP); Takahiro Itami, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/545,505

(22) Filed: Jul. 10, 2012

(65) Prior Publication Data

US 2013/0021133 A1 Jan. 24, 2013

(30) Foreign Application Priority Data

Jul. 21, 2011 (JP) ..... 2011-160028

(51) Int. Cl.
*H01C 7/10* (2006.01)

(52) U.S. Cl.
USPC ..... 338/21; 338/307; 338/332; 338/327; 29/610.1

(58) Field of Classification Search
USPC ..... 338/21, 327, 328, 332, 307, 309
See application file for complete search history.

(56) References Cited

U.S. PATENT DOCUMENTS

| | | | | |
|---|---|---|---|---|
| 4,495,482 | A * | 1/1985 | Philipp | 338/21 |
| 4,692,735 | A * | 9/1987 | Shoji et al. | 338/21 |
| 4,839,097 | A * | 6/1989 | Noi et al. | 252/520.21 |
| 6,232,867 | B1 * | 5/2001 | Yoshida et al. | 338/21 |
| 7,095,310 | B2 * | 8/2006 | Imai et al. | 338/21 |

FOREIGN PATENT DOCUMENTS

| | | |
|---|---|---|
| JP | A-01-295403 | 11/1989 |

* cited by examiner

*Primary Examiner* — Kyung Lee
(74) *Attorney, Agent, or Firm* — Oliff & Berridge, PLC

(57) ABSTRACT

A varistor is provided with a varistor element body, a plurality of internal electrodes arranged in the varistor element body so as to sandwich a partial region of the varistor element body between them, and a plurality of external electrodes arranged on the surface of the varistor element body and connected to the corresponding internal electrodes. The external electrode has a sintered electrode layer formed by attaching an electroconductive paste containing an alkali metal to the surface of the varistor element body and sintering it. The varistor element body has a high-resistance region formed by diffusing the alkali metal in the electroconductive paste into the varistor element body from an interface between the surface of the varistor element body and the sintered electrode layer.

7 Claims, 8 Drawing Sheets

(a)

(b)

(c)

(a)

(b)

(c)

(a)

(b)

VARISTOR AND METHOD FOR MANUFACTURING VARISTOR

BACKGROUND OF THE INVENTION

1. Field of the Invention

The present invention relates to a varistor and a method for manufacturing the varistor.

2. Related Background Art

A known varistor is one having a varistor element body comprised of a semiconducting ceramic material to exhibit the nonlinear current-voltage characteristic, a plurality of internal electrodes arranged in the varistor element body so as to sandwich a partial region of the varistor element body between them, and a plurality of external electrodes arranged on the surface of the varistor element body and connected to the corresponding internal electrodes (e.g., cf Japanese Patent Application Laid-open No. H01-295403 (which will be referred to hereinafter as "Patent Literature 1"))

SUMMARY OF THE INVENTION

With recent increase in speed of digital signals and communication speed, there are demands for a low-capacitance varistor causing little influence on signals.

It is an object of the present invention to provide a varistor capable of securely achieving a reduction in capacitance, while maintaining the good nonlinear current-voltage characteristic, and a method for manufacturing the varistor.

The inventors conducted elaborate research on the varistor capable of securely achieving the reduction in capacitance and discovered the new fact as described below.

The capacitance of varistor includes not only the capacitance formed between the internal electrodes, but also the capacitance formed between the external electrodes. The capacitance formed between the internal electrodes can be lowered by adjusting the distance or the overlap area between the internal electrodes or by adjusting the relative dielectric constant of the varistor element body. However, any one of them causes influence on electrical characteristics of the varistor (e.g., ESD tolerance and nonlinear current-voltage characteristic) and may degrade the electrical characteristics. Therefore, the capacitance can be reduced by decreasing the capacitance formed between the external electrodes, while maintaining good electrical characteristics of varistor.

When an alkali metal diffuses into a semiconducting ceramic material, a region with the diffused alkali metal in the semiconducting ceramic material comes to have lower electric conductivity (or higher electric resistance) and lower relative dielectric constant. Accordingly, when the region between the external electrodes in the varistor element body contains the region with the diffused alkali metal, the capacitance becomes lowered in the region between the external electrodes in the varistor element body, thus achieving the reduction in capacitance of the varistor. In the varistor described in Patent Literature 1, a high-resistance region (high-resistance layer) is formed on the surface of the varistor element body, by thermally diffusing at least one of Li, Na, and K from the surface of the varistor element body into the varistor element body.

In the varistor described in Patent Literature 1, after the high-resistance region is formed by thermally diffusing at least one of Li, Na, and K from the surface of the varistor element body into the varistor element body, the external electrodes are formed on the surface of the varistor element body. For this reason, the varistor described in Patent Literature 1 has the problem as described below, which is the new fact discovered by the inventors.

The external electrodes are formed by attaching an electroconductive paste to the surface of the varistor element body and sintering it. The electroconductive paste to be used is, generally, one obtained by mixing a glass component (e.g., glass fit or the like) and an organic vehicle in a metal powder. The glass component has high reactivity with the alkali metal. In the process of sintering the electroconductive paste on the surface of the varistor element body, the alkali metal having diffused in the varistor element body diffuses toward the electroconductive paste (external electrodes) because of heat during the sintering. The diffused alkali metal can react with the glass component in the electroconductive paste to be incorporated into the external electrodes.

If the alkali metal having diffused in the varistor element body becomes incorporated into the external electrodes, the concentration of the alkali metal will decrease in regions near the interfaces to the external electrodes in the varistor element body. For this reason, the regions near the interfaces to the external electrodes in the varistor element body have lower electric resistance and higher relative dielectric constant. Therefore, reduction in capacitance of varistor is impeded in the varistor described in Patent Literature 1. The varistor described in Patent Literature 1 is one to prevent plating growth by increasing the electric resistance of the region between the external electrodes in the surface of the varistor element body, i.e., the electric resistance of the portion exposed from the external electrodes in the surface of the varistor element body, but is not one to achieve the reduction in capacitance like the present invention.

In light of the above-described research result, a varistor according to the present invention is a varistor comprising: a varistor element body comprised of a semiconducting ceramic material to exhibit the nonlinear current-voltage characteristic; a plurality of internal electrodes arranged in the varistor element body so as to sandwich a partial region of the varistor element body between the internal electrodes; and a plurality of external electrodes arranged on the surface of the varistor element body and connected to the corresponding internal electrodes, wherein the external electrode has a sintered electrode layer formed by attaching an electroconductive paste containing an alkali metal to the surface of the varistor element body and sintering the electroconductive paste, and wherein the varistor element body has a high-resistance region formed by diffusing the alkali metal in the electroconductive paste into the varistor element body from an interface between the surface of the varistor element body and the sintered electrode layer.

In the varistor according to the present invention, the varistor element body has the high-resistance region formed by diffusing the alkali metal in the electroconductive paste into the varistor element body from the interface between the surface of the varistor element body and the sintered electrode layer. The high-resistance region is located so as to be securely sandwiched between the external electrodes. Accordingly, the region between the external electrodes in the varistor element body comes to have lower capacitance, thereby achieving the reduction in capacitance of the varistor.

Since the alkali metal diffuses into the varistor element body from the interface between the surface of the varistor element body and the sintered electrode layer, it does not diffuse so far as reaching the region between the internal electrodes in the varistor element body. Therefore, the alkali metal having diffused in the varistor element body causes no influence on the nonlinear current-voltage characteristic of the varistor.

The high-resistance region is formed by diffusing the alkali metal in the electroconductive paste into the varistor element body from the interface between the surface of the varistor element body and the sintered electrode layer. For this reason, the varistor of the present invention is free of the reduction in concentration of the diffused alkali metal as seen in the varistor described in Patent Literature 1. In the present invention, the electric resistance of the high-resistance region is readily adjusted to a desired value.

In the varistor described in Patent Literature 1, the electric resistance becomes higher in the periphery of the region between the external electrodes in the surface of the varistor element body. However, since the region with the increased electric resistance extends in a direction in which the external electrodes are opposed to each other, it makes extremely little contribution to the reduction in capacitance.

The alkali metal may be at least one of Li, Na, and K.

The varistor element body may contain ZnO as major component. In this case, the alkali metal, particularly, Li, Na, and K, diffuses into crystal grains of ZnO to form an acceptor, and thus the high-resistance region is formed well.

A varistor manufacturing method according to the present invention is a method for manufacturing a varistor comprising: a varistor element body comprised of a semiconducting ceramic material to exhibit the nonlinear current-voltage characteristic; a plurality of internal electrodes arranged in the varistor element body so as to sandwich a partial region of the varistor element body between the internal electrodes; and a plurality of external electrodes arranged on the surface of the varistor element body and connected to the corresponding internal electrodes, the method comprising: a preparation step of preparing the varistor element body in which the plurality of internal electrodes are arranged; and an external electrode forming step of forming the plurality of external electrodes on the surface of the varistor element body, wherein the external electrode forming step comprises: attaching an electroconductive paste containing an alkali metal to the surface of the varistor element body and sintering the electroconductive paste to form a sintered electrode layer; and diffusing the alkali metal in the electroconductive paste into the varistor element body from an interface between the surface of the varistor element body and the sintered electrode layer to form a high-resistance region.

In the varistor manufacturing method according to the present invention, while the electroconductive paste is attached to the surface of the varistor element body and sintered to form the sintered electrode layer, the alkali metal in the electroconductive paste is diffused into the varistor element body from the interface between the surface of the varistor element body and the sintered electrode layer to form the high-resistance region. Therefore, as described above, the reduction in capacitance of the varistor is achieved and the alkali metal having diffused in the varistor element body causes no influence on the nonlinear current-voltage characteristic of the varistor. It is also feasible to readily adjust the electric resistance of the high-resistance region to a desired value.

The method may further comprise an alkali metal diffusion step of diffusing the alkali metal from the surface of the varistor element body into the interior of the varistor element body, prior to the external electrode forming step. In this case, the high-resistance region is also formed in a region exposed from the external electrodes in the surface of the varistor element body, so as to extend along the region, which can securely achieve increase in resistance of the entire surface of the varistor element body.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description, the same elements or elements with the same functionality will be denoted by the same reference signs, without redundant description.

Figure 1:
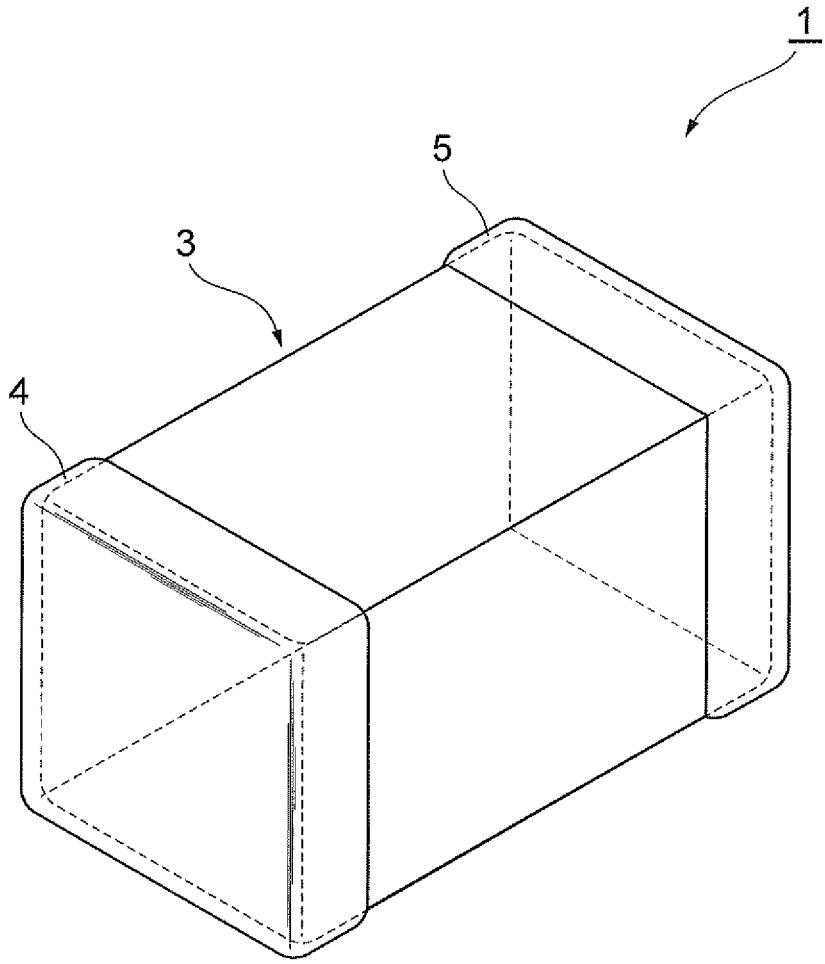
FIG. 1 is a perspective view showing a multilayer chip varistor according to an embodiment of the present invention.
Figure 2:
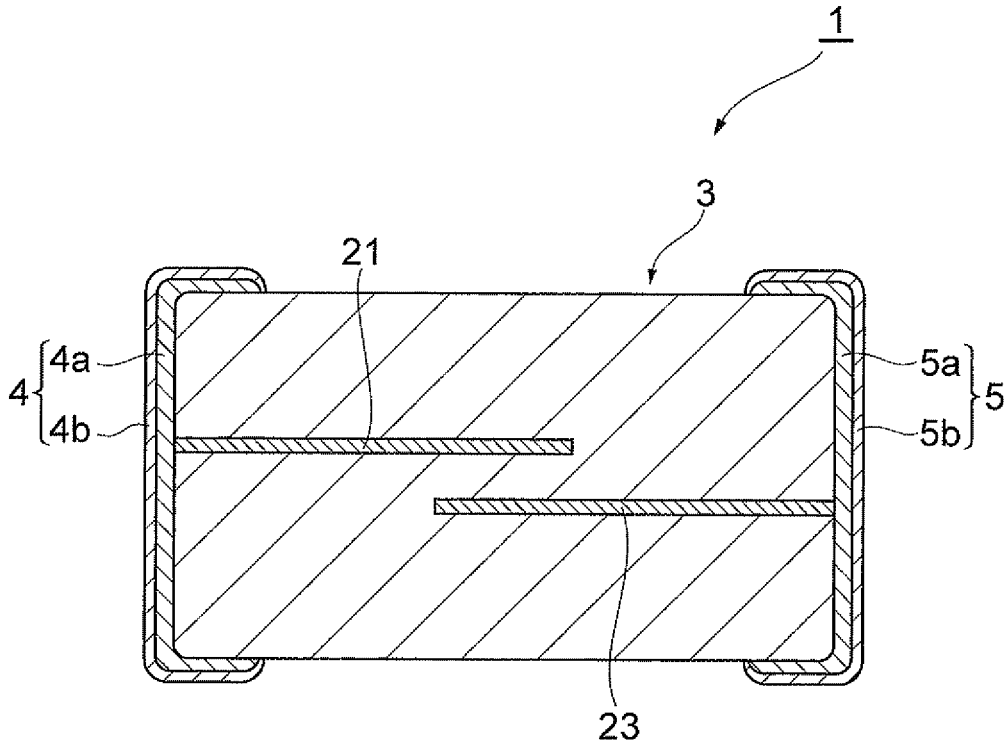
FIG. 2 is a drawing illustrating a cross-sectional configuration of the multilayer chip varistor according to the embodiment.
Figure 3:
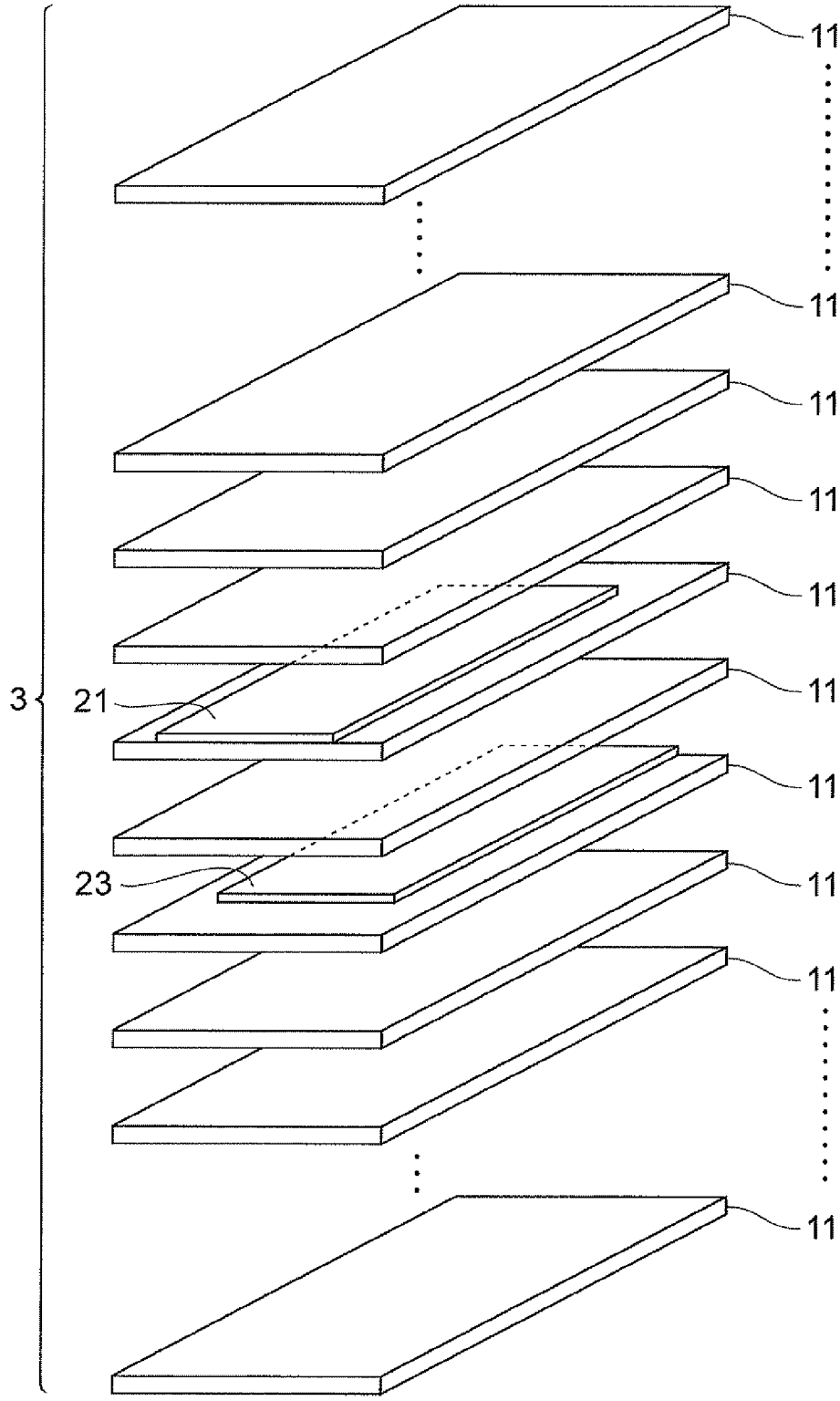
FIG. 3 is an exploded perspective view of a varistor element body in the multilayer chip varistor according to the embodiment.

First, a configuration of multilayer chip varistor 1 according to an embodiment of the present invention will be described with reference to FIGS. 1 to 3. FIG. 1 is a perspective view showing the multilayer chip varistor according to the present embodiment. FIG. 2 is a drawing illustrating a cross-sectional configuration of the multilayer chip varistor according to the present embodiment. FIG. 3 is an exploded perspective view of a varistor element body in the multilayer chip varistor according to the present embodiment. The present embodiment will describe the multilayer chip varistor 1 as an example of varistor.

The multilayer chip varistor 1, as shown in FIGS. 1 and 2, has a varistor element body 3, and a plurality of external electrodes (a pair of external electrodes in the present embodiment) 4, 5 arranged on the surface of the varistor element body 3. The varistor element body 3 is of a rectangular parallelepiped shape and is set, for example, in the length of 0.6 mm, the width of 0.3 mm, and the height of 0.3 mm. The multilayer chip varistor 1 of the present embodiment is a multilayer chip varistor of a so-called 0603 type. The size of the multilayer chip varistor 1 does not always have to be limited to the foregoing size, but the multilayer chip varistor 1 may be, for example, a multilayer chip varistor of a 1001 size.

The varistor element body 3, as shown in FIG. 3, is constructed as a laminated body in which a plurality of varistor layers 11 having the nonlinear current-voltage characteristic (which will be referred to hereinafter as "varistor characteristic") are laminated together. In the multilayer chip varistor 1, in practice, the plurality of varistor layers 11 are integrally combined so that no boundary can be visually recognized between them. The varistor element body 3 is a ceramic element body which is composed of a stack of ceramic layers of a semiconducting ceramic material.

The varistor layers 11 of ceramic layers (varistor element body 3) contain ZnO (zinc oxide) as major component and also contain as minor components, metals such as Co, rare-earth metals, Group IIIb elements (B, Al, Ga, In), Si, Cr, Mo, alkali metals (K, Rb, Cs), and alkaline-earth metals (Mg, Ca, Sr, Ba), or oxides of these metals. In the present embodiment, the varistor layers 11 contain Co, Pr, Cr, Ca, K, Si, and Al as minor components.

Co acts as a substance that forms acceptor levels in grain boundaries of ZnO so as to exhibit the varistor characteristic. The rare-earth metals (e.g., Pr and others) are also materials for exhibiting the varistor characteristic. There are no particular restrictions on a content of ZnO in the varistor layers 11, but the content is normally from 99.8% to 69.0% by mass when all the materials constituting the varistor layers 11 are 100% by mass.

The external electrodes 4, 5 are arranged at end portions of the varistor element body 3 and provided so as to cover two end faces of the varistor element body 3. Each of the paired external electrodes 4, 5 has a first electrode layer 4*a*, 5*a* and a second electrode layer 4*b*, 5*b*, respectively. The first electrode layers 4*a*, 5*a* are formed on the surface of the varistor element body 3. The first electrode layers 4*a*, 5*a* are formed by attaching an electroconductive paste to the surface of the varistor element body 3 and sintering it, as described below. Namely, the first electrode layers 4*a*, 5*a* are sintered electrode layers. The electroconductive paste to be used herein is one obtained by mixing a glass component, an alkali metal, an organic binder, and an organic solvent in a metal powder (Ag particles, Ag—Pd alloy particles, or the like).

The second electrode layers 4*b*, 5*b* are formed by plating on the first electrode layers 4*a*, 5*a*. In the present embodiment, each second electrode layer 4*b*, 5*b* includes an Ni-plated layer formed by Ni plating on the first electrode layer 4*a*, 5*a*, and an Sn-plated layer formed by Sn plating on the Ni-plated layer. The second electrode layers 4*b*, 5*b* are formed for the purposes of improving solder leach resistance and solderability, mainly, on the occasion of mounting the multilayer chip varistor 1 on an external board or the like by reflow soldering.

The second electrode layers 4*b*, 5*b* do not always have to be limited to the aforementioned combination of materials as long as the purposes of improving solder leach resistance and solderability are achieved. The plated layers do not always have to be limited to the two-layer structure, but may have a single-layer structure or a three- or more-layer structure.

The multilayer chip varistor 1, as shown in FIGS. 2 and 3, has a plurality of internal electrodes (a pair of internal electrodes in the present embodiment) 21, 23 in the varistor element body 3. The plurality of internal electrodes 21, 23 are alternately arranged so as to sandwich a partial region of the varistor element body 3 (varistor layers 11) between them in a lamination direction of the varistor layers 11. The internal electrodes 21, 23 are made of an electroconductive material that is normally used as internal electrodes of multilayer electric elements (e.g., Ag, an Ag—Pd alloy, or the like). The internal electrodes 21, 23 are constructed as sintered bodies of an electroconductive paste containing the foregoing electroconductive material.

The internal electrode 21 is connected to the external electrode 4 (first electrode layer 4*a*), at an end thereof exposed in the surface of the varistor element body 3. The internal electrode 23 is connected to the external electrode 5 (first electrode layer 5*a*), at an end thereof exposed in the surface of the varistor element body 3.

Figure 4:
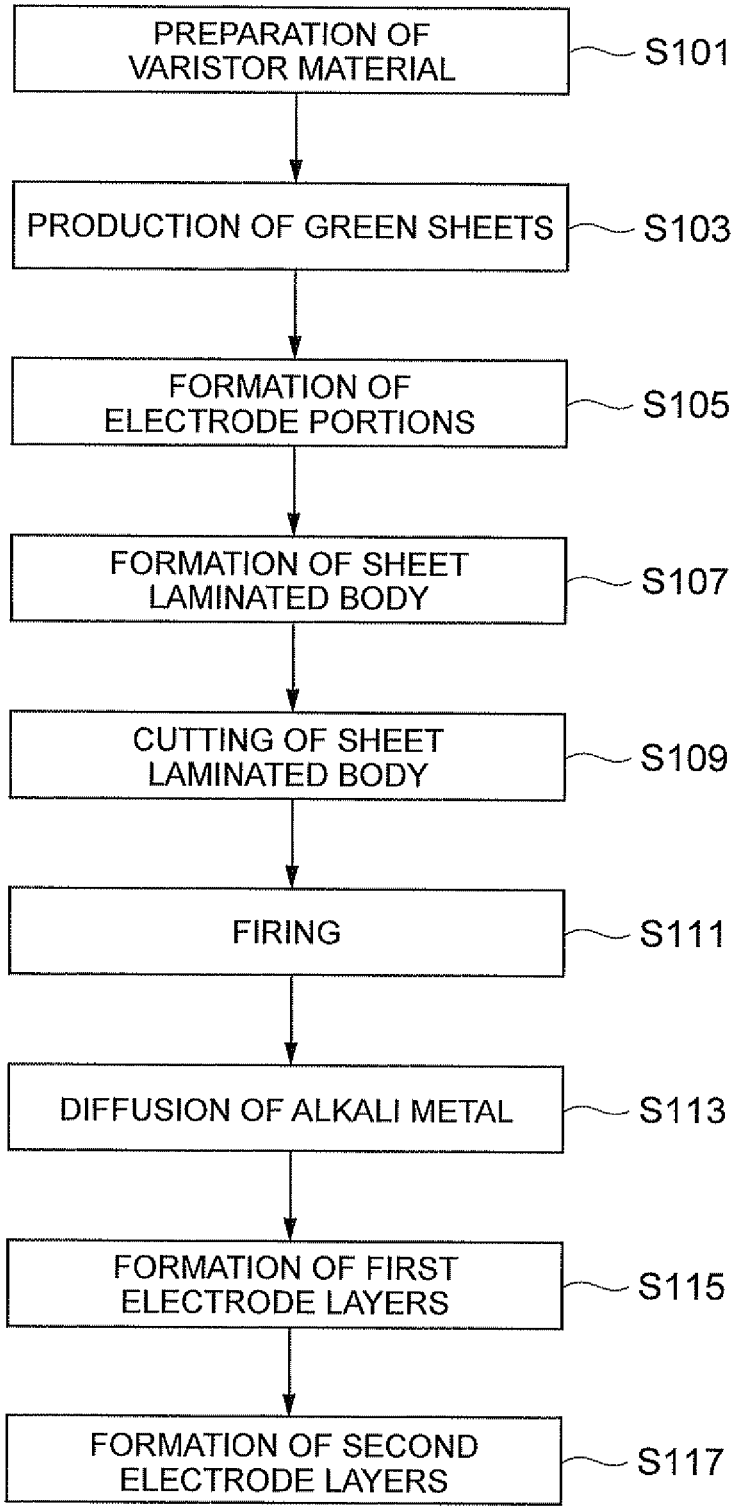
FIG. 4 is a flowchart for explaining a process for manufacturing the multilayer chip varistor according to the embodiment.
Figure 5:
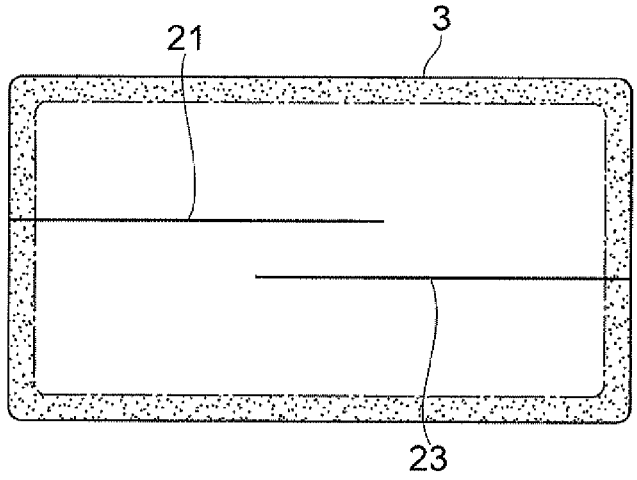
FIG. 5 is a schematic drawing for explaining diffusion of alkali metal.
Figure 5:
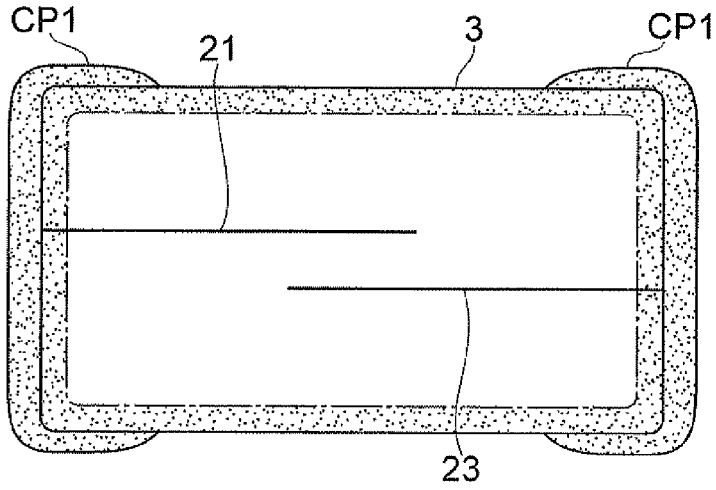
Figure 5:
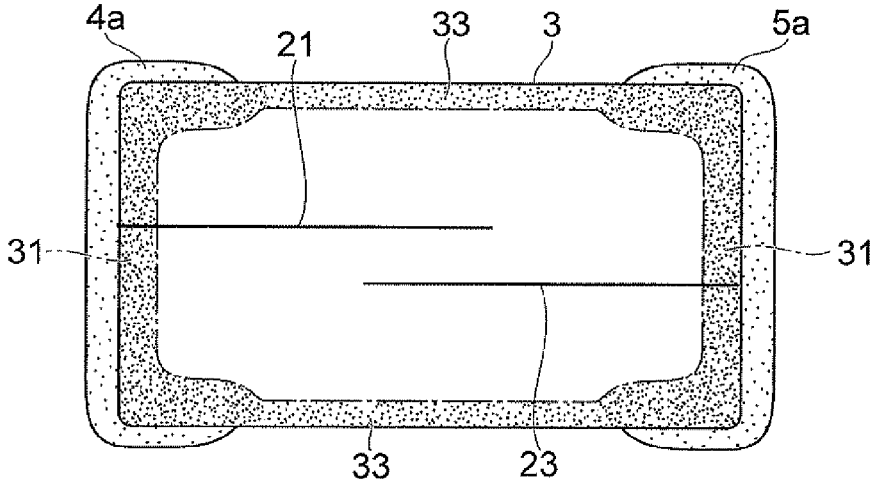

A process for manufacturing the multilayer chip varistor 1 having the above-described configuration will be described below with reference to FIG. 4. FIG. 4 is a flowchart for explaining the process for manufacturing the multilayer chip varistor according to the present embodiment. FIG. 5 is a schematic drawing for explaining states in which an alkali metal diffuses in the varistor element body. In FIG. 5, the existence of the alkali metal is indicated by hatching dots and the higher the density of dots, the higher the concentration of the alkali metal. In FIG. 5, dotted regions in the varistor element body 3 represent regions in which the alkali metal has diffused, but it should be noted that the regions are schematically shown for explanation and do not always agree with regions in which the alkali metal has diffused in the actual varistor element body.

First, a varistor material is prepared by weighing each of ZnO principally constituting the varistor layers 11, and trace additives such as metals of Pr, Co, Cr, Ca, Si, K, and Al or oxides thereof at a predetermined ratio, and then mixing the components (S101). Thereafter, an organic binder, an organic solvent, an organic plasticizer, etc. are added in this varistor material and they are mixed and pulverized for about 20 hours with a ball mill or the like to obtain a slurry.

The resultant slurry is applied onto film, for example, of polyethylene terephthalate by a known method such as the doctor blade method, and then it is dried to form membranes in the thickness of about 30 μm. The membranes obtained in this manner are then peeled off from the film to produce green sheets (S103).

Next, a plurality of electrode portions (as many as divided chips described below) corresponding to the internal electrodes 21, 23 are formed on the green sheets (S105). The electrode portions corresponding to the internal electrodes 21, 23 are formed by printing patterns of an electroconductive paste, which is obtained by mixing a metal powder as the aforementioned electroconductive material, an organic binder, and an organic solvent, by a printing method such as screen printing, and drying them.

Next, the green sheets with the electrode portions thereon, and the green sheets without any electrode portions are stacked in a predetermined order to form a sheet laminated body (S107). The sheet laminated body obtained in this manner is cut in chip units to obtain a plurality of divided green chips (S109).

Then the green chips are debindered and fired to obtain sintered bodies (varistor element bodies 3) (S111). The above processes are to prepare the varistor element bodies 3 (preparation process). The debindering process is carried out, for example, by heating the green chips at the temperature of 250 to 450° C. for about ten minutes to eight hours. The firing process is carried out, for example, by firing the green chips at the temperature of 1100 to 1350° C. for about ten minutes to eight hours. This firing turns the green sheets into varistor layers 11 and the electrode portions into corresponding internal electrodes 21, 23.

Next, as shown in (a) of FIG. 5, an alkali metal (e.g., Li, Na, or K) is made to diffuse from the surface of each varistor element body 3 into the interior of the varistor element body 3 (S113: alkali metal diffusion process). In this process, first, an alkali metal compound is deposited on the surface of the varistor element body 3. The deposition of the alkali metal compound can be implemented using a hermetically-sealed rotary pot. There are no particular restrictions on the alkali metal compound, but it can be a compound whose alkali metal can diffuse to a predetermined depth from the surface of the varistor element body 3 by a thermal treatment, e.g., an oxide, hydroxide, chloride, nitrate, borate, carbonate, or oxalate of the alkali metal.

Subsequently, the varistor element bodies 3 with the alkali metal compound deposited thereon are thermally treated at a predetermined temperature and for a predetermined time in an electric furnace. As a result, the alkali metal from the alkali metal compound thermally diffuses from the surface of the varistor element body 3 thereinto. The preferred temperature for the thermal treatment is from 700° C. to 1000° C. and a thermal treatment atmosphere is air. The thermal treatment time (retention time) is preferably from ten minutes to four hours.

Next, the external electrodes 4, 5 are formed on the surface of each varistor element body 3 (external electrode forming process). First, as shown in (b) and (c) of FIG. 5, an electroconductive paste CP1 for external electrodes 4, 5 (first electrode layers 4*a*, 5*a*) is attached to the surface of the varistor element body 3 and then sintered (S115: sintered electrode layer forming process). This process results in forming the first electrode layers 4*a*, 5*a* as sintered electrode layers. In this process, the electroconductive paste CP 1 is attached to the two end portions of the varistor element body 3 so as to make contact with each of the internal electrodes 21, 23, and then is dried. Thereafter, the varistor element body 3 is thermally treated at a predetermined temperature (e.g., 650 to 950° C.) to sinter the electroconductive paste CP 1 on the varistor element body 3. The thermal treatment time (retention time) is preferably from ten minutes to three hours.

The electroconductive paste CP1 for external electrodes 4, 5 to be used herein is one obtained by mixing the glass component, alkali metal, organic binder, and organic solvent in the metal powder, as described above. The metal powder applicable herein can be a metal powder containing Ag—Pd alloy particles or Ag particles as major component.

The glass component can be a glass frit containing $B_2O_3$—SiO—ZnO-based glass as major component. A content of the glass component in the electroconductive paste is, for example, approximately from 2% to 8% by mass when the entire electroconductive paste is 100% by mass. A content of the metal powder in the electroconductive paste is, for example, approximately from 60% to 80% by mass when the entire electroconductive paste is 100% by mass.

The alkali metal is preferably at least one of Li, Na, and K. The alkali metal is contained in a state of an alkali metal compound in the electroconductive paste, as in S113. The alkali metal compound to be used herein can be an oxide, hydroxide, chloride, nitrate, borate, carbonate, or oxalate of the alkali metal. For example, in the case of Li, $Li_2CO_3$ is contained in the electroconductive paste. A content of the alkali metal compound in the electroconductive paste is, for example, approximately from 3% to 15% by mass when the entire electroconductive paste is 100% by mass.

In the present embodiment, after diffusing the alkali metal from the surface of the varistor element body 3 into the interior of the varistor element body 3, the electroconductive paste CP1 containing the metal powder, glass component, alkali metal, and organic vehicle (organic binder and organic solvent) is attached to the varistor element body 3 and then sintered. This process results in forming the first electrode layers 4*a*, 5*a*. While the electroconductive paste CP1 is sintered on the varistor element body 3, the alkali metal in the electroconductive paste CP1 thermally diffuses into the varistor element body 3 from interfaces between the surface of the varistor element body 3 and the first electrode layers 4*a*, 5*a*. On this occasion, the alkali metal already having diffused in the varistor element body 3 is inhibited from diffusing into the electroconductive paste CP1 (first electrode layers 4*a*, 5*a*) because the electroconductive paste CP1 contains the alkali metal. Part of the alkali metal in the electroconductive paste CP1 reacts with the glass component in the electroconductive paste CP1, remaining in the first electrode layers 4*a*, 5*a*.

In the varistor element body 3, as described above, high-resistance regions 31 are formed, as shown in (c) of FIG. 5, in such a manner that the alkali metal in the electroconductive paste CP1 for first electrode layers 4*a*, 5*a* diffuses into the varistor element body 3 from the interfaces between the surface of the varistor element body 3 and the first electrode layers 4*a*, 5*a*. The high-resistance regions 31 are located at end portions of the varistor element body 3 and are formed, mainly, along the interfaces between the varistor element body 3 and the first electrode layers 4*a*, 5*a* in the varistor element body 3. The high-resistance regions 31 are located between the first electrode layer 4*a* and the first electrode layer 5*a*, in a direction in which the first electrode layer 4*a* and the first electrode layer 5*a* are opposed to each other. In the present embodiment, the high-resistance regions 31 also contain the alkali metal having diffused in the alkali metal diffusion process S113.

The high-resistance regions 31 contain the alkali metal having diffused in the sintered electrode layer forming process 8115, in addition to the alkali metal having diffused in the alkali metal diffusion process S113. For this reason, as shown in (c) of FIG. 5, the thickness of the high-resistance regions 31 is larger than that of high-resistance region 33 formed, mainly, along the region between the first electrode layers 4*a*, 5*a* in the surface of the varistor element body 3 in the varistor element body 3. The high-resistance region 33 is formed, mainly, of the alkali metal having diffused in the alkali metal diffusion process S113.

Reference is made again to FIG. 4. Next, an Ni-plated layer and an Sn-plated layer are successively deposited on the first electrode layers 4*a*, 5*a* of the external electrodes 4, 5 to form second electrode layers 4*b*, 5*b* (S117: plated electrode layer forming process). The multilayer chip varistors 1 are obtained in this manner. The Ni plating can be implemented by a barrel plating method using an Ni plating bath (e.g., Watts bath). The Sn plating can be implemented by a barrel plating method using an Sn plating bath (e.g., neutral Sn plating bath).

In the present embodiment, as described above, the varistor element body 3 has the high-resistance regions 31 formed in such a manner that the alkali metal in the electroconductive paste for external electrodes 4, 5 (first electrode layers 4*a*, 5*a*) diffuses into the varistor element body 3 from the interfaces between the surface of the varistor element body 3 and the first electrode layers 4*a*, 5*a*. Namely, in the process of attaching the electroconductive paste to the surface of the varistor element body 3 and sintering it to form the first electrode layers 4*a*, 5*a*, the alkali metal in the electroconductive paste is made to diffuse into the varistor element body 3 from the interfaces between the surface of the varistor element body 3 and the first electrode layers 4*a*, 5*a* to form the high-resistance regions 31. For this reason, the high-resistance regions 31 are located so as to be securely sandwiched between the external electrodes 4, 5. This configuration results in reducing the capacitance of the region between the external electrodes 4, 5 in the varistor element body 3, which achieves reduction in capacitance of the multilayer chip varistor 1.

As the content of the alkali metal increases, the concentration of the diffused alkali metal becomes higher and the capacitance of the multilayer chip varistor 1 tends to decrease. As the heating temperature (sintering temperature) of the electroconductive paste containing the alkali metal increases, the concentration of the diffused alkali metal becomes higher and the capacitance of the multilayer chip varistor 1 tends to decrease.

Since the alkali metal diffuses into the varistor element body 3 from the interfaces between the surface of the varistor element body 3 and the first electrode layers 4*a*, 5*a*, it does not diffuse so far as reaching the region between the internal electrodes 21, 23 in the varistor element body 3. Therefore, the alkali metal having diffused in the varistor element body 3 causes no effect on the nonlinear current-voltage characteristic of the multilayer chip varistor 1.

The high-resistance regions 31 are formed by the diffusion of the alkali metal in the electroconductive paste into the varistor element body 3 from the interfaces between the surface of the varistor element body 3 and the first electrode layers 4*a*, 5*a*. For this reason, the multilayer chip varistor 1 of the present embodiment is free of the reduction in concentration of the diffused alkali metal as seen in the varistor described in Patent Literature 1, and allows the electric resistance of the high-resistance regions 31 to be readily adjusted to a desired value.

Figure 6:
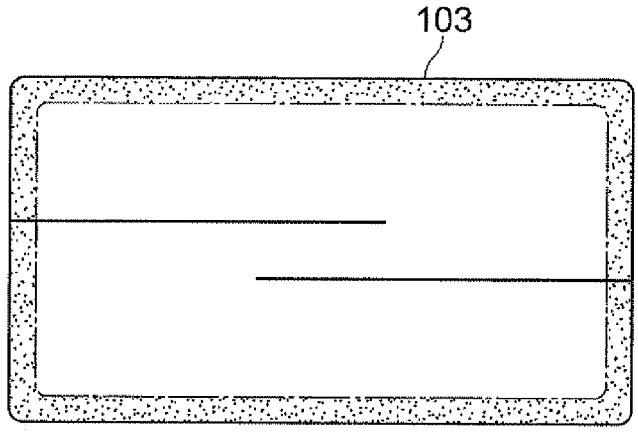
FIG. 6 is a schematic drawing for explaining diffusion of alkali metal.
Figure 6:
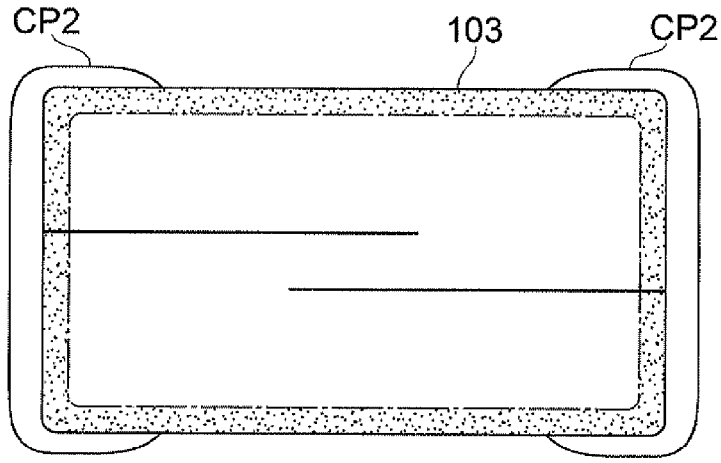
Figure 6:
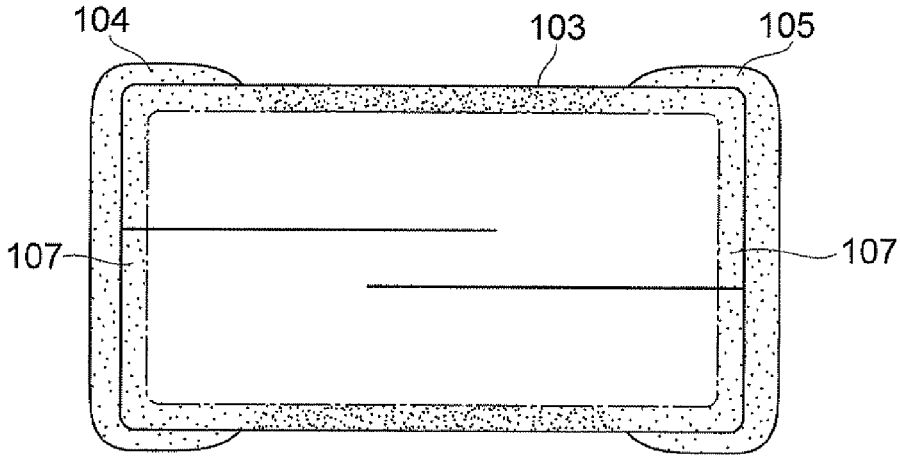

In the varistor described in Patent Literature 1, sintered electrode layers 104, 105 are formed as shown in (a) to (c) of FIG. 6. Namely, after diffusing the alkali metal from the surface of the varistor element body 103 into the interior of the varistor element body 103, an electroconductive paste CP2 containing a metal powder, a glass component, and an organic vehicle is attached to the varistor element body 103 and then sintered. While the electroconductive paste CP2 is sintered on the varistor element body 103, the alkali metal having diffused in the varistor element body 103 can diffuse toward the electroconductive paste CP2 (sintered electrode layers 104, 105) because of heat in the sintering. The alkali metal diffusing into the electroconductive paste CP2 (sintered electrode layers 104, 105) reacts with the glass component in the electroconductive paste CP2 to be incorporated into the sintered electrode layers 104, 105. In FIG. 6, as in FIG. 5, the existence of the alkali metal is indicated by hatching dots and the higher the density of dots, the higher the concentration of the alkali metal. In FIG. 6, the dotted regions in the varistor element body 103 represent the regions with the diffused alkali metal, but it should be noted that the regions are schematically shown for explanation and do not always agree with regions with the diffused alkali metal in the actual varistor element body.

When the alkali metal having diffused in the varistor element body 103 is incorporated into the sintered electrode layers 104, 105, the concentration of the alkali metal decreases in regions 107 near interfaces to the sintered electrode layers 104, 105, in the varistor element body 103. Therefore, the regions 107 come to have lower electric resistance and higher relative dielectric constant. This configuration results in impeding the reduction in capacitance of varistor, in the varistor described in Patent Literature 1.

The varistor element body 3 contains ZnO as major component. Since the alkali metal, particularly, Li, Na, and K, diffuses into crystal grains of ZnO to form an acceptor, the high-resistance regions 31 are formed well. Furthermore, Li has a relatively small ionic radius, high solid solubility in crystal grains of ZnO, and a high diffusion rate.

In the present embodiment, the alkali metal is made to diffuse from the surface of the varistor element body 3 into the interior of the varistor element body 3, prior to forming the external electrodes 4, 5 (first electrode layers 4*a*, 5*a*). For this reason, the high-resistance region is also formed in the region exposed from the external electrodes 4, 5 in the surface of the varistor element body 3, so as to extend along the region. As a consequence, it is feasible to securely achieve increase in resistance of the entire surface of the varistor element body 3.

The above described the preferred embodiment of the present invention, but it should be noted that the present invention is not always limited to the above embodiment but can be modified in many ways without departing from the spirit and scope of the invention.

Figure 7:
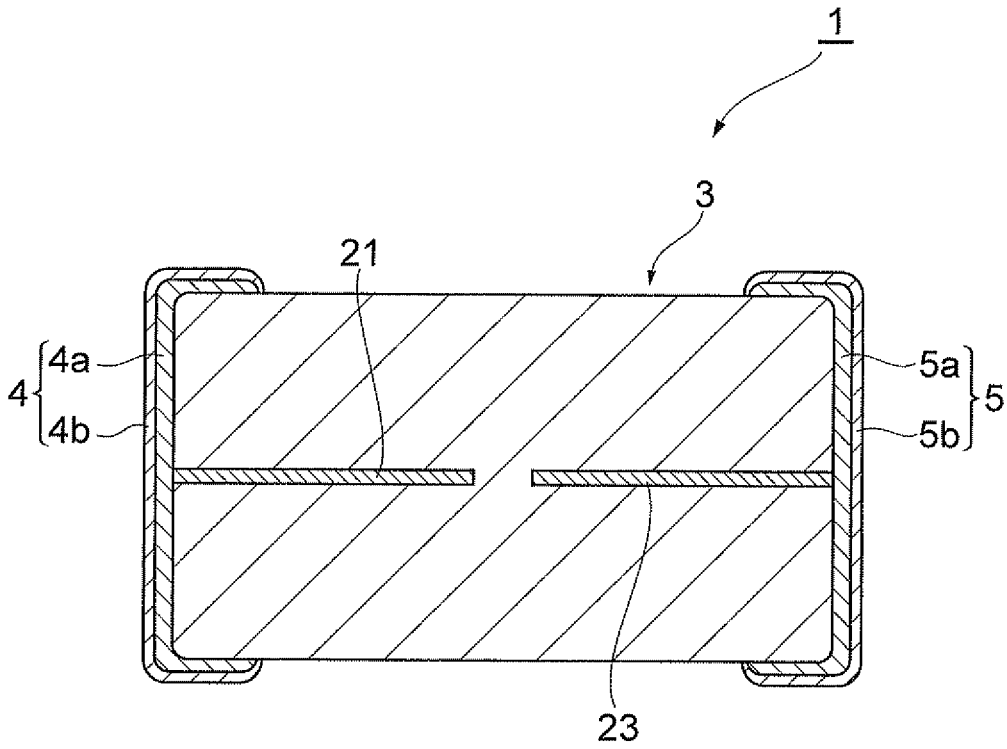
FIG. 7 is a drawing illustrating a cross-sectional configuration of a multilayer chip varistor according to a modification example of the embodiment.

The plurality of internal electrodes 21, 23 are alternately arranged so as to sandwich the partial region of the varistor element body 3 (varistor layers 11) between them in the lamination direction of the varistor layers 11, but they do not always have to be limited to this configuration. For example, as shown in FIG. 7, the plurality of internal electrodes 21, 23 may be arranged so as to sandwich a partial region of the varistor element body 3 between them in a direction intersecting with the lamination direction of varistor layers 11 (e.g., in a direction perpendicular to the lamination direction).

Figure 8:
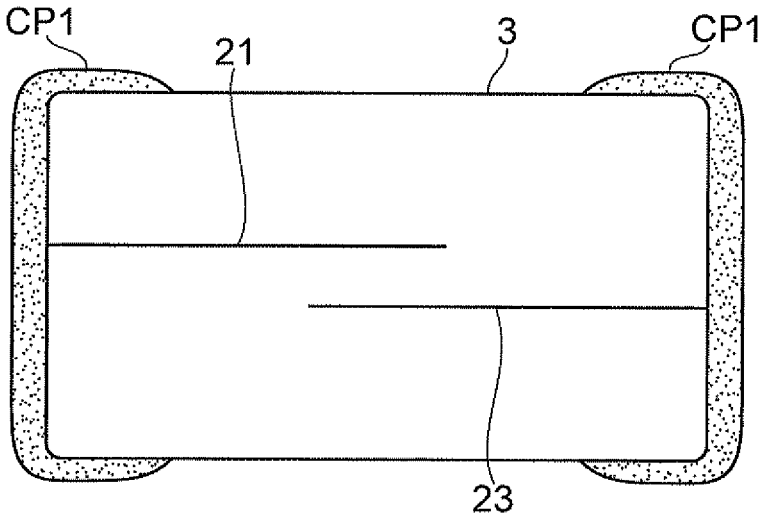
FIG. 8 is a schematic drawing for explaining diffusion of alkali metal.
Figure 8:
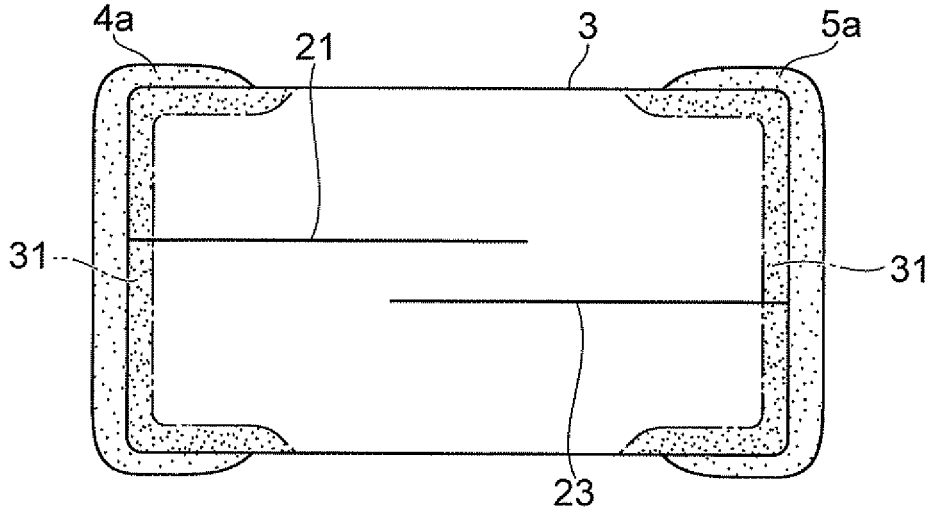

The alkali metal diffusion process S113 may be omitted. In this case, as shown in (a) and (b) of FIG. 8, the alkali metal in the electroconductive paste CP1 for first electrode layers 4*a*, 5*a* also diffuses into the varistor element body 3 from the interfaces between the surface of the varistor element body 3 and the first electrode layers 4*a*, 5*a*, thereby to form the high-resistance regions 31 well. In FIG. 8, the existence of the alkali metal is indicated by hatching dots and the higher the density of dots, the higher the concentration of the alkali metal. In FIG. 8, dotted regions in the varistor element body 3 represent regions with the diffused alkali metal, but it should be noted that the regions are schematically shown for explanation and do not always agree with regions with the diffused alkali metal in the actual varistor element body.

The thickness of the high-resistance regions 31 formed without the alkali metal diffusion process S113 is smaller than that of the high-resistance regions 31 formed with the alkali metal diffusion process S113. Even if the alkali metal diffusion process S113 is omitted, the high-resistance regions 31 can be suitably formed throughout the entire surface of the varistor element body 3 by controlling the concentration of the alkali metal in the electroconductive paste CP1 for first electrode layers 4*a*, 5*a*.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A varistor comprising:

a varistor element body comprised of a semiconducting ceramic material to exhibit the nonlinear current-voltage characteristic;

a plurality of internal electrodes arranged in the varistor element body so as to sandwich a partial region of the varistor element body between the internal electrodes; and a plurality of external electrodes arranged on the surface of the varistor element body and connected to the corresponding internal electrodes, wherein the external electrode has a sintered electrode layer formed by attaching an electroconductive paste containing an alkali metal to the surface of the varistor element body and sintering the electroconductive paste, and wherein the varistor element body has a high-resistance region formed by diffusing the alkali metal in the electroconductive paste into the varistor element body from an interface between the surface of the varistor element body and the sintered electrode layer.

2. The varistor according to claim 1, wherein the alkali metal is at least one of Li, Na, and K.

3. The varistor according to claim 1, wherein the varistor element body contains ZnO as major component.

4. A method for manufacturing a varistor comprising: a varistor element body comprised of a semiconducting ceramic material to exhibit the nonlinear current-voltage characteristic; a plurality of internal electrodes arranged in the varistor element body so as to sandwich a partial region of the varistor element body between the internal electrodes; and a plurality of external electrodes arranged on the surface of the varistor element body and connected to the corresponding internal electrodes, the method comprising:

a preparation step of preparing the varistor element body in which the plurality of internal electrodes are arranged; and an external electrode forming step of forming the plurality of external electrodes on the surface of the varistor element body, wherein the external electrode forming step comprises: attaching an electroconductive paste containing an alkali metal to the surface of the varistor element body and sintering the electroconductive paste to form a sintered electrode layer; and diffusing the alkali metal in the electroconductive paste into the varistor element body from an interface between the surface of the varistor element body and the sintered electrode layer to form a high-resistance region.

5. The method according to claim 4, wherein the alkali metal is at least one of Li, Na, and K.

6. The method according to claim 4, wherein the varistor element body contains ZnO as major component.

7. The method according to claim 4, further comprising:

an alkali metal diffusion step of diffusing the alkali metal from the surface of the varistor element body into the interior of the varistor element body, prior to the external electrode forming step.

* * * * *